US009945152B2

(12) United States Patent
Huang et al.

(10) Patent No.: US 9,945,152 B2
(45) Date of Patent: Apr. 17, 2018

(54) CLUTCH DRIVING MODULE OF A LOCK

(71) Applicant: TAIWAN FU HSING INDUSTRIAL CO., LTD., Kaohsiung (TW)

(72) Inventors: Chao-Ming Huang, Kaohsiung (TW); Wen-Chieh Lee, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 266 days.

(21) Appl. No.: 15/071,290

(22) Filed: Mar. 16, 2016

(65) Prior Publication Data

US 2016/0340931 A1 Nov. 24, 2016

(30) Foreign Application Priority Data

May 22, 2015 (TW) ..... 104116533 A

(51) Int. Cl.

| | |
|---|---|
| ***E05B 13/10*** | (2006.01) |
| ***E05B 17/04*** | (2006.01) |
| ***E05B 1/00*** | (2006.01) |
| ***E05B 27/00*** | (2006.01) |
| ***E05B 27/08*** | (2006.01) |
| ***E05B 13/00*** | (2006.01) |

(52) U.S. Cl.

CPC ..... *E05B 13/10* (2013.01); *E05B 1/003* (2013.01); *E05B 13/002* (2013.01); *E05B 13/105* (2013.01); *E05B 17/044* (2013.01); *E05B 27/0003* (2013.01); *E05B 27/0046* (2013.01); *E05B 27/08* (2013.01)

(58) Field of Classification Search

CPC ..... E05B 13/00; E05B 13/002; E05B 13/004; E05B 13/005; E05B 13/10; E05B 13/101; E05B 13/105; E05B 13/106; E05B 17/00; E05B 17/044; E05B 17/045; E05B 17/046

See application file for complete search history.

(56) References Cited

U.S. PATENT DOCUMENTS 4,201,069 A * 5/1980 Katayama ..... E05B 17/0062 70/224
5,868,018 A * 2/1999 Kang ..... E05B 13/101 70/149

(Continued)

FOREIGN PATENT DOCUMENTS

CN 200978560 Y 11/2007
CN 200992837 Y 12/2007

(Continued)

OTHER PUBLICATIONS

Taiwanese Office Action dated May 10, 2016 for Taiwanese Patent Application No. 104116533, 8 pages.

(Continued)

*Primary Examiner* — Christopher J Boswell
(74) *Attorney, Agent, or Firm* — Jackson IPG PLLC; Demian K. Jackson

(57) ABSTRACT

A clutch driving module is disposed in a lock which is able to drive the clutch driving module selectively to control an exterior handle assembly whether be able to drive a latch assembly in lock or unlock or not. And the clutch driving module is able to respectively make an interior handle assembly and the exterior handle assembly controlling the lock in lock or unlock independently.

12 Claims, 14 Drawing Sheets

(56) References Cited

U.S. PATENT DOCUMENTS 5,934,117 A * 8/1999 Shen ..... E05B 55/06 70/149
6,041,630 A * 3/2000 Shen ..... E05B 13/101 70/149
6,189,351 B1 * 2/2001 Eagan ..... E05B 13/101 292/DIG. 27
6,357,270 B1 * 3/2002 Vazquez ..... E05B 13/101 292/336.3
6,497,126 B2 * 12/2002 Wang ..... E05B 13/101 70/224
6,575,006 B1 * 6/2003 Don ..... E05B 13/101 70/149
6,742,367 B2 * 6/2004 Wu ..... E05B 13/101 292/336.3
6,935,148 B2 * 8/2005 Don ..... E05B 13/10 70/224
7,934,754 B2 * 5/2011 Mathachan ..... E05B 13/002 292/336.3
8,491,023 B2 * 7/2013 Brannaman ..... E05B 17/005 292/336.3
8,939,477 B2 * 1/2015 Welsby ..... E05B 55/005 292/347
9,267,311 B2 2/2016 Huang et al.

FOREIGN PATENT DOCUMENTS

| | | |
|---|---|---|
| CN | 101424140 A | 5/2009 |
| TW | M255299 | 1/2005 |
| TW | M350588 | 2/2009 |
| TW | 201135040 A1 | 10/2011 |
| TW | M432689 | 7/2012 |

OTHER PUBLICATIONS

Chinese Office Action dated Dec. 28, 2017 for Chinese Patent Application No. 201510434377.2, 5 pages.

* cited by examiner

CLUTCH DRIVING MODULE OF A LOCK

FIELD OF THE INVENTION

The present invention relates to a clutch driving module of a lock which is able to be driven by a lock cylinder assembly selectively to control a handle with the lock cylinder assembly whether can unlatch a latch assembly.

BACKGROUND OF THE INVENTION

Referring to FIG. 1, a lock 100 is usually disposed on a door for security or personnel access control, wherein the lock 100 includes an interior handle assembly 110, a latch assembly 120, an exterior handle assembly 130 and a retractor 140. A latch 121 of the latch assembly 120 is lodged into a door frame, an exterior handle 131 of the exterior handle assembly 130 is not able to drive the retractor 140 to drive the latch 121 of the latch assembly 120 in operation when a control button 111 of the interior handle assembly 110 is pressed or turned, and the lock 100 is locked.

Turn an interior handle 112 of the interior handle assembly 110 to restore the control button 111 and unlock the lock 100 when the door is intend to unlock.

Or, use a key 150 to drive a lock cylinder assembly 132 of the exterior handle assembly 130 to restore the control button 111 of the interior handle assembly 110 and unlock the lock 100.

Owing to the reason that the control button 111 of the interior handle assembly 110 must be pressed or turned before lock the door 100, so the exterior handle assembly 130 is not able to lock the door 100 when the control button 111 of the interior handle assembly 110 is not pressed or turned, therefore causes inconvenience of the user.

SUMMARY

The primary object of the present invention is to provide a clutch driving module of a lock which is selectively driven to lock or unlock a lock by an interior handle assembly or an exterior handle assembly.

The clutch driving module of a lock of the present invention includes a first driving tube, a driving member, a second driving tube, a sleeve, a sliding member and a driving rod. The first driving tube comprises a first ring wall, a first accommodating space, a longitudinal slot and a first lateral constraining hole communicating with the longitudinal slot, wherein the longitudinal slot and the first lateral constraining hole pass through the first ring wall and communicate with the first accommodating space. The driving member is rotatably disposed in the first accommodating space of the first driving tube. The second driving tube is rotatably disposed in the first accommodating space of the first driving tube and comprises a second ring wall, a second accommodating space and a second lateral constraining hole, wherein the second lateral constraining hole passes through the second ring wall and communicates with the second accommodating space. The sleeve is rotatably disposed in the second accommodating space of the second driving tube and comprises a third ring wall, a third accommodating space and a triangle-shaped through hole disposed on the third ring wall, wherein the triangle-shaped through hole communicates with the third accommodating space, and the second lateral constraining hole of the second driving tube reveals the triangle-shaped through hole. The sliding member is disposed in the third accommodating space of the sleeve and is able to move laterally in the third accommodating space, wherein the triangle-shaped through hole reveals the sliding member. The driving rod comprises a coupling portion and a bearing portion, wherein the coupling portion is coupled with the sliding member, and the bearing portion penetrates through the triangle-shaped through hole of the sleeve, the second lateral constraining hole of the second driving tube and the first lateral constraining hole of the first driving tube.

In this invention, the clutch driving module disposed in a lock is able to be driven selectively. The lock can be locked or unlocked by driving the clutch driving module, and the clutch driving module of the lock is able to respectively make an interior handle assembly and an exterior handle assembly lock or unlock the lock independently.

DETAILED DESCRIPTION OF THE INVENTION

Figure 1:
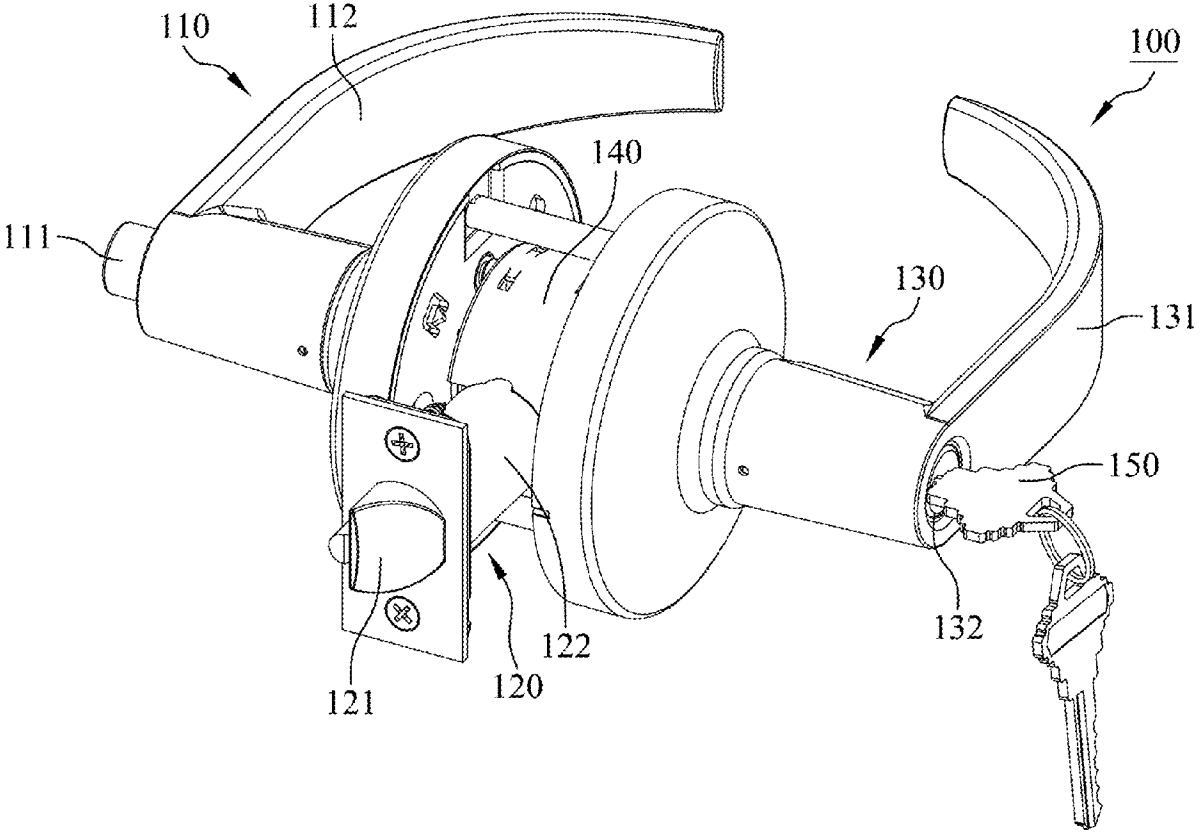
FIG. 1 PRIOR ART
FIG. 1 is a perspective diagram of a conventional lock.
Figure 2:
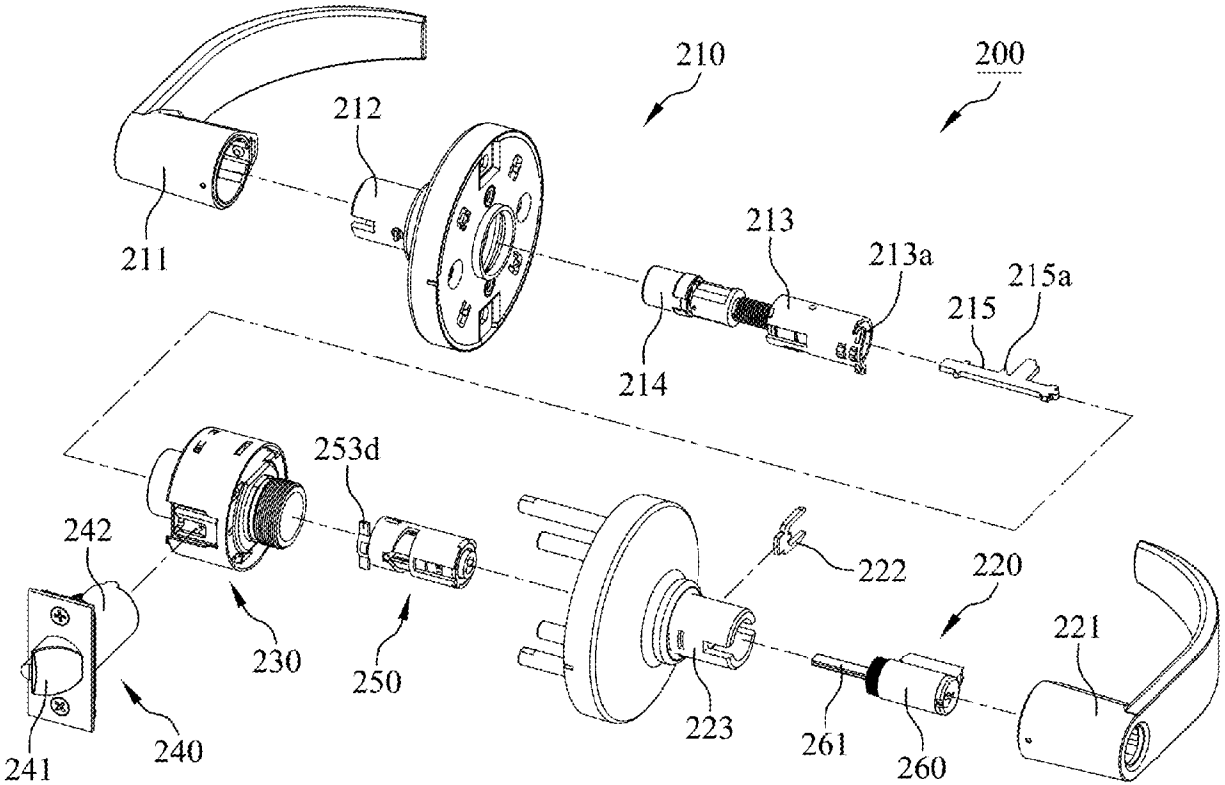
FIG. 2 is a perspective exploded diagram illustrating a lock in accordance with the present invention.
Figure 3:
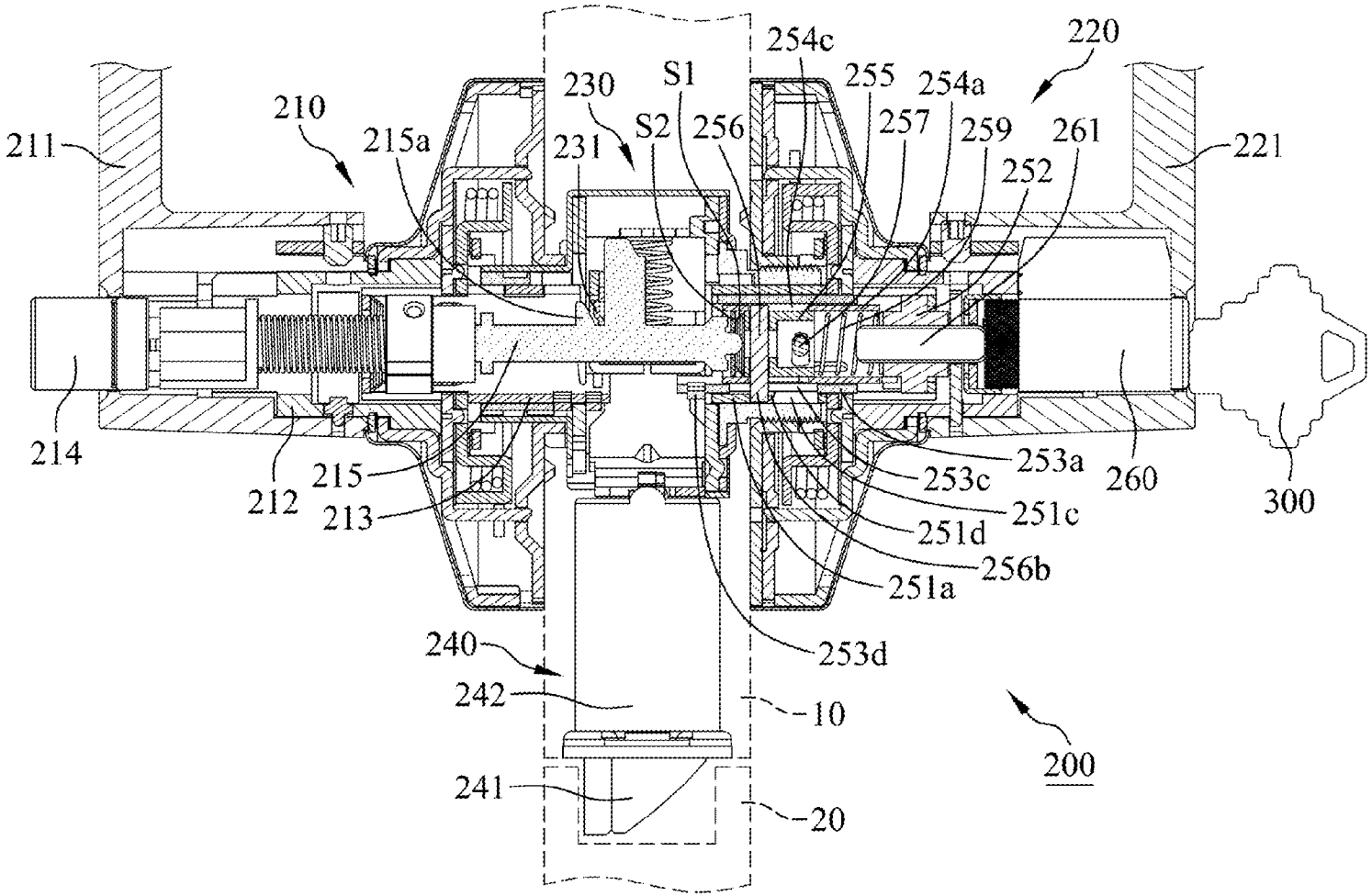
FIG. 3 is a section view diagram illustrating the lock in accordance with the present invention.

With reference to FIGS. 2 and 3, a clutch driving module 250 is disposed in a lock 200 in accordance with an embodiment of the present invention, wherein the lock 200 includes an interior handle assembly 210, an exterior handle assembly 220, a retractor 230, a latch assembly 240 and the clutch driving module 250. The retractor 230 is disposed between the interior handle assembly 210 and the exterior handle assembly 220 and is able to be driven by the interior handle assembly 210, the exterior handle assembly 220 or the clutch driving module 250 to make a latch 241 of the latch assembly 240 retracting into a cylinder body 242.

Figure 4:
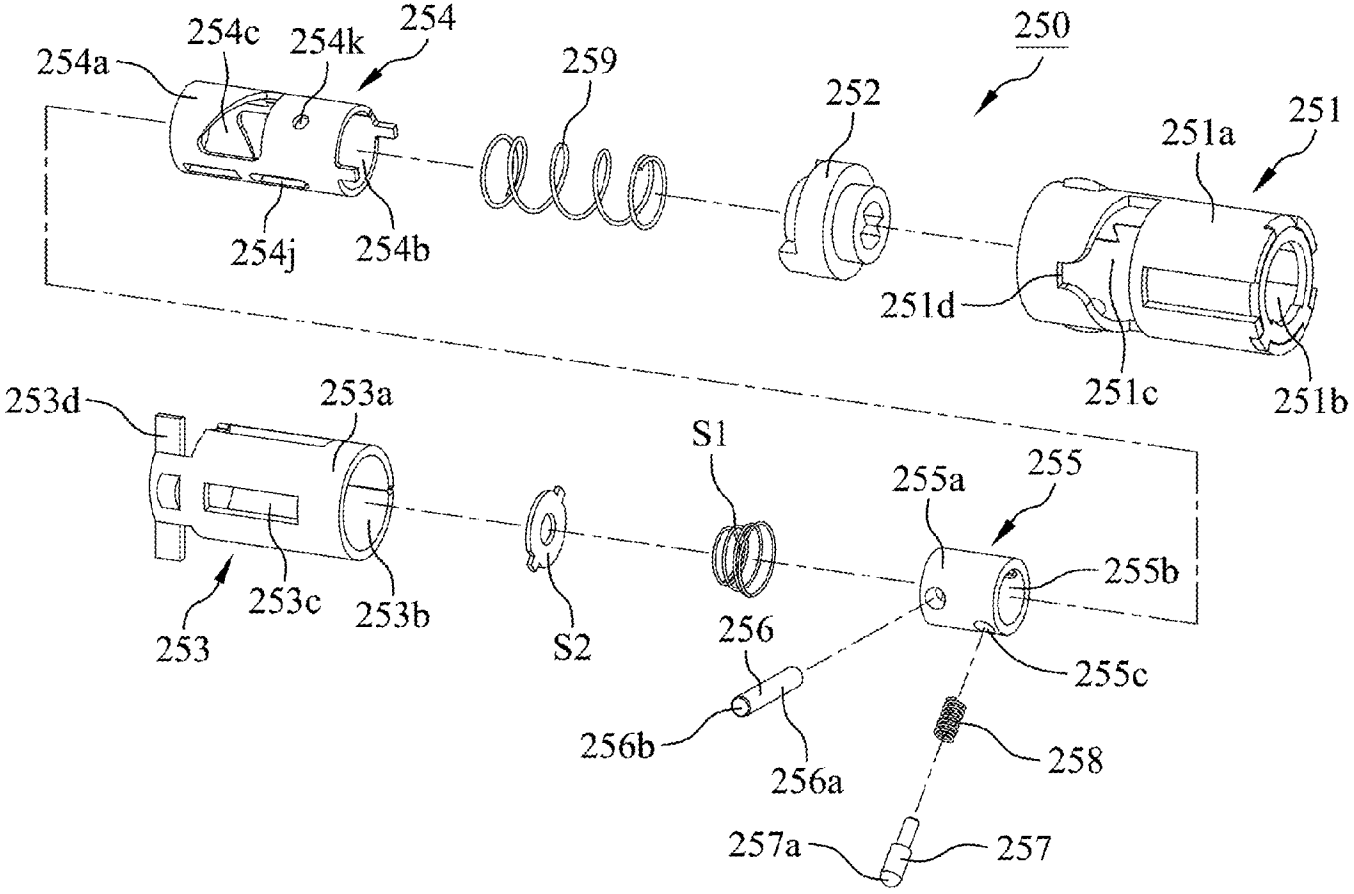
FIG. 4 is a perspective exploded diagram illustrating a clutch driving module of the lock in accordance with the present invention.
Figure 5A:
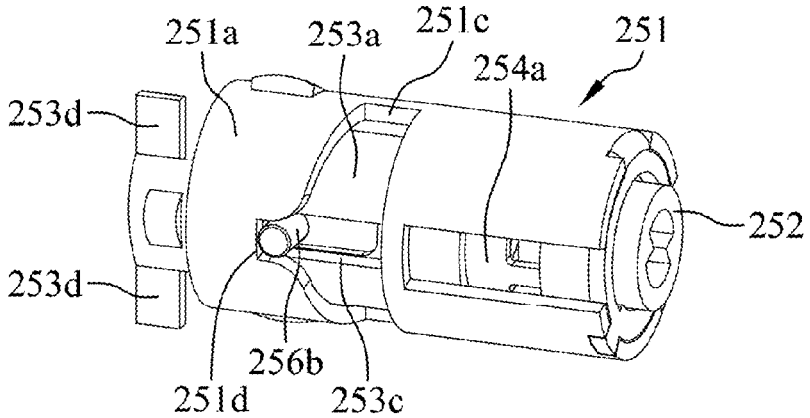
FIG. 5A is a perspective diagram illustrating the clutch driving module of the lock in accordance with the present invention.
Figure 5B:
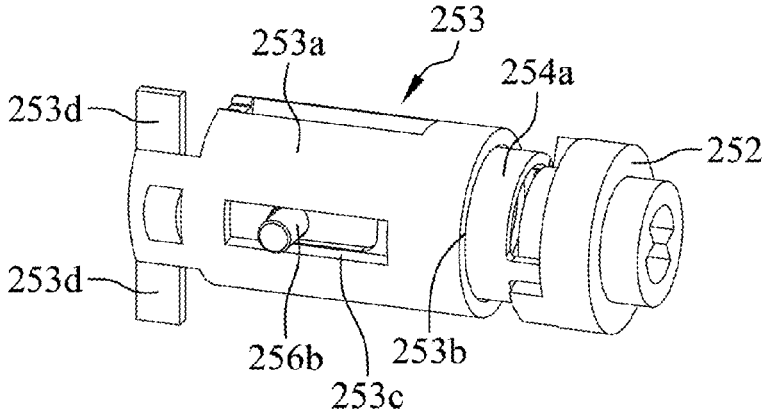
FIG. 5B is a partial perspective diagram illustrating the clutch driving module of the lock in accordance with the present invention.
Figure 5C:
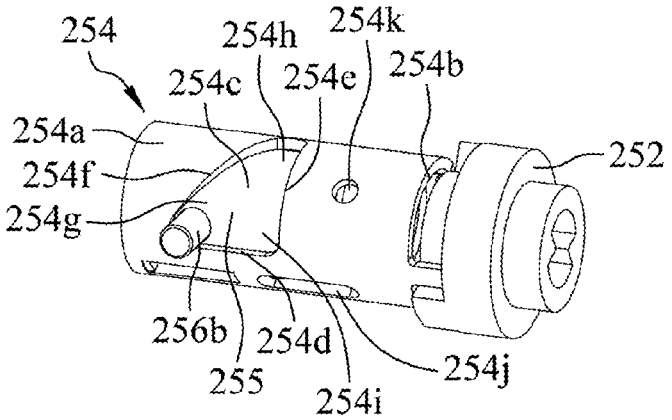
FIG. 5C is a partial perspective diagram illustrating the clutch driving module of the lock in accordance with the present invention.

With reference to FIGS. 2, 3, 4, 5A, 5B and 5C, the clutch driving module 250 of the lock 200 includes a first driving tube 251, a driving member 252, a second driving tube 253, a sleeve 254, a sliding member 255 and a driving rod 256. FIG. 5A is a perspective assembly diagram illustrating the clutch driving module 250 of the lock 200. FIG. 5B is a perspective assembly diagram illustrating the first driving tube 251 being hidden from FIG. 5A. FIG. 5C is a perspective assembly diagram illustrating the first driving tube 251 and the second driving tube 253 both being hidden from FIG. 5A.

With reference to FIGS. 3, 4, 5A, the first driving tube 251 comprises a first ring wall 251*a*, a first accommodating space 251*b*, a longitudinal slot 251*c* and a first lateral constraining hole 251*d* communicates laterally with the longitudinal slot 251*c*, wherein the longitudinal slot 251*c* and the first lateral constraining hole 251*d* pass through the first ring wall 251*a* and communicate with the first accommodating space 251*b*.

Figure 6:
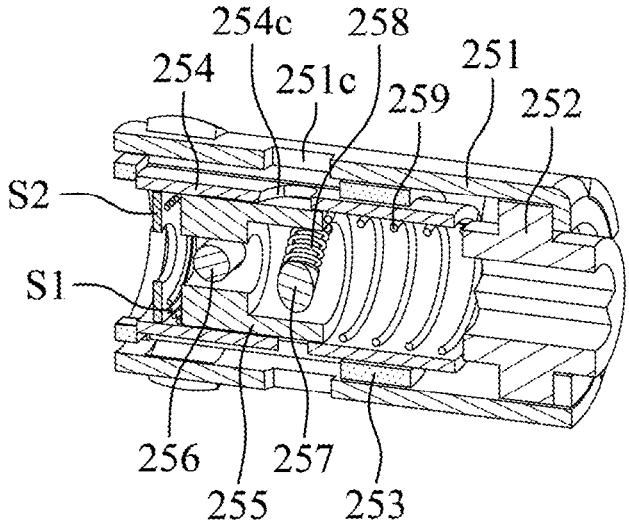
FIG. 6 is a perspective section view diagram illustrating the clutch driving module of the lock in accordance with the present invention.

With reference to FIGS. 4, 5A and 6, the driving member 252 is rotatably disposed in the first accommodating space 251*b* of the first driving tube 251.

With reference to FIGS. 4, 5A, 5B and 6, the second driving tube 253 is rotatably disposed in the first accommodating space 251*b* of the first driving tube 251 and comprises a second ring wall 253*a*, a second accommodating space 253*b* and a second lateral constraining hole 253*c*, wherein the second lateral constraining hole 253*c* passes through the second ring wall 253*a* and communicates with the second accommodating space 253*b*. In this embodiment, the second ring wall 253*a* comprises a pushing portion 253*d*.

Figure 7:
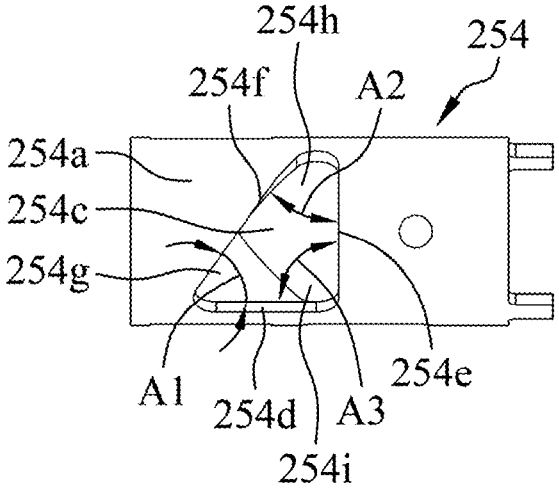
FIG. 7 is a front view diagram illustrating a sleeve in accordance with the present invention.

With reference to FIGS. 4, 5A, 5B, 5C and 6, the sleeve 254 is rotatably disposed in the second accommodating space 253*b* of the second driving tube 253 and comprises a third ring wall 254*a*, a third accommodating space 254*b* and a triangle-shaped through hole 254*c* disposed on the third ring wall 254*a*, wherein the triangle-shaped through hole 254*c* communicates with the third accommodating space 254*b*, and the second lateral constraining hole 253*c* of the second driving tube 253 reveals the triangle-shaped through hole 254*c*. With reference to FIG. 7, the triangle-shaped through hole 254*c* comprises a lateral wall 254*d*, a longitudinal wall 254*e* and a pushing wall 254*f*, wherein one end of the pushing wall 254*f* connects with the lateral wall 254*d* and the other end of the pushing wall 254*f* connects with the longitudinal wall 254*e*. A first included angle A1 is defined between the lateral wall 254*d* and the pushing wall 254*f*, and there is a first area 254*g* in the terminal of the first included angle A1. A second included angle A2 is defined between the pushing wall 254*f* and the longitudinal wall 254*e*, and there is a second area 254*h* in the terminal of the second included angle A2. A third included angle A3 is defined between the longitudinal wall 254*e* and the lateral wall 254*d*, and there is a third area 254*i* in the terminal of the third included angle A3.

With reference to FIGS. 4, 5A, 5B, 5C and 6, the sliding member 255 is disposed in the third accommodating space 254*b* of the sleeve 254 and enables to move laterally in the third accommodating space 254*b*, wherein the triangle-shaped through hole 254*c* of the sleeve 254 reveals the sliding member 255.

With reference to FIGS. 4, 5A, 5B, 5C, 6 and 8, the driving rod 256 is coupled with the sliding member 255. In this embodiment, the driving rod 256 comprises a coupling portion 256*a* and a bearing portion 256*b*, wherein the coupling portion 256*a* is coupled with the sliding member 255. In this embodiment, the bearing portion 256*b* is revealed by the triangle-shaped through hole 254*c* and passes through the triangle-shaped through hole 254*c*, the second lateral constraining hole 253*c* of the second driving tube 253 and the first lateral constraining hole 251*d* of the first driving tube 251. Referring to FIGS. 5C and 7, the bearing portion 256*b* is located at the first area 254*g* of the triangle-shaped through hole 254*c*.

Figure 8:
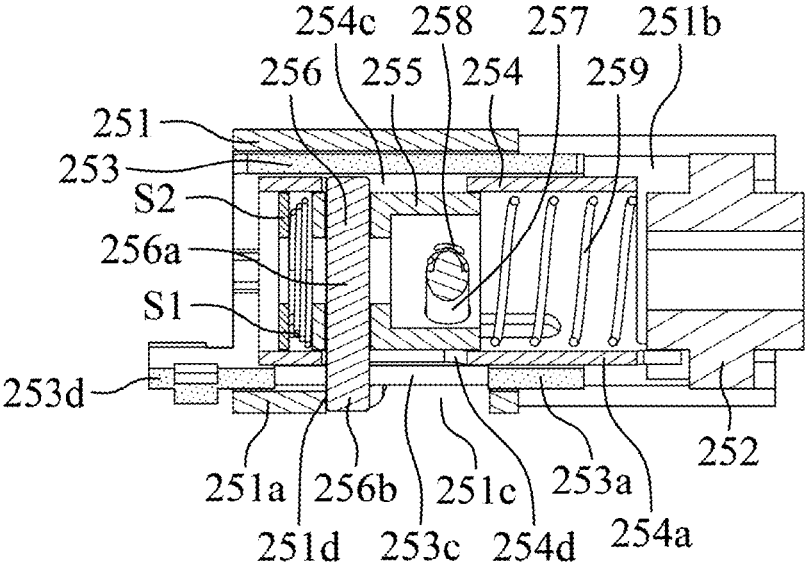
FIG. 8 is a lateral section view diagram illustrating the clutch driving module of the lock in accordance with the present invention.

With reference to FIGS. 4, 6 and 8, the clutch driving member 250 of the lock 200 further includes a positioning member 257 and at least one elastic member 258, wherein the positioning member 257 is disposed at the sliding member 255, and one end of the elastic member 258 contacts against the positioning member 257 and the other end of the elastic member 258 contacts against the sliding member 255. The positioning member 257 comprises a positioning protrusion 257*a* protruding to the sliding member 255, wherein the positioning protrusion 257*a* contacts against the third ring wall 254*a* of the sleeve 254. Referring to FIGS. 4 and 5C, in this embodiment, the sleeve 254 comprises a positioning slot 254*j* and a positioning hole 254*k* which are disposed through the third ring wall 254*a*, wherein the positioning protrusion 257*a* is able to move laterally in the positioning slot 254*j* or be constrained in the positioning hole 254*k*. The moving path of the positioning member 257 is corresponded to the driving rod 256.

Figure 9:
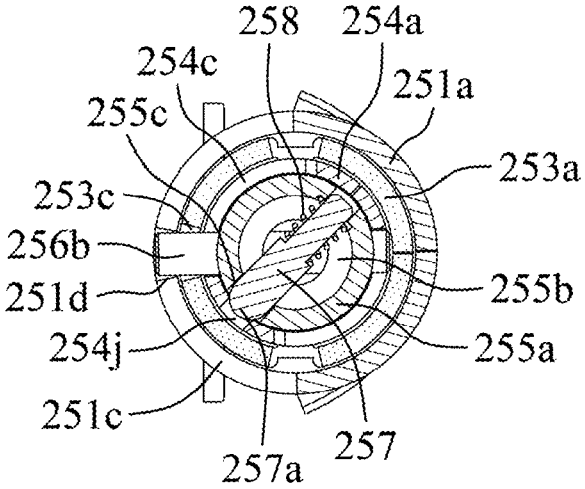
FIG. 9 is a longitudinal section view diagram illustrating the clutch driving module of the lock in accordance with the present invention

With reference to FIGS. 4, 6, 8 and 9, in this embodiment, the sliding member 255 comprises a fourth ring wall 255*a*, a fourth accommodating space 255*b* and a through hole 255*c*, wherein the through hole 255*c* passes through the fourth ring wall 255*a* and communicates with the fourth accommodating space 255*b*. The positioning member 257 and the elastic member 258 are disposed in the fourth accommodating space 255*b*, and one end of the elastic member 258 contacts against the fourth ring wall 255*a* and the other end of the elastic member 258 contacts against the positioning protrusion 257*a*. The positioning protrusion 257*a* protrudes to the fourth ring wall 255*a* via the through hole 255*c*. Referring to FIG. 9, the positioning protrusion 257*a* is accommodated in the positioning slot 254*j*, and the positioning protrusion 257*a* is able to be accommodated in the positioning hole 254*k* when the sleeve 254 in rotation.

With reference to FIGS. 4, 6 and 8, the clutch driving module 250 of the lock 200 further includes at least one elastic member 259, wherein the elastic member 259 is disposed in the third accommodating space 254*b* of the sleeve 254 and is located between the driving member 252 and the sliding member 255. The elastic member 259 is compressed between the driving member 252 and the sliding member 255 to generate a restoration elastic force when the sliding member 255 moves toward the driving member 252. Preferably, the clutch driving module 250 of the lock 200 further includes at least one elastic member S1 and a blocking plate S2, wherein the elastic member S1 and the blocking plate S2 are disposed in the third accommodating space 254*b* of the sleeve 254, the sliding member 255 is located between the elastic member 259 and the elastic member S1, and the elastic member S1 is located between the blocking plate S2 and the sliding member 255.

With reference to FIG. 3, the lock 200 is mounted on a door 10, and the latch 241 of the latch assembly 240 protrudes to the cylinder body 242 and is lodged into a frame 20. The lock 200 is not locked, so the interior handle assembly 210 or the exterior handle assembly 220 is able to drive the retractor 230 to retract the latch 241 of the latch assembly 240 into the cylinder body 242, and then the door 10 is able to be opened.

With reference to FIGS. 2, 3, 10 and 11, in this embodiment, an interior handle 211 of the interior handle assembly 210 is able to be turned to drive an inner axial tube 212 and an inner driving axial tube 213 rotate when the lock 200 is unlocked. And a lateral wing plate 213*a* of the inner driving axial tube 213 is able to press the retractor 230 to drive the latch 241 of the latch assembly 240 retract into the cylinder body 242 to open the door 10.

Figure 10:
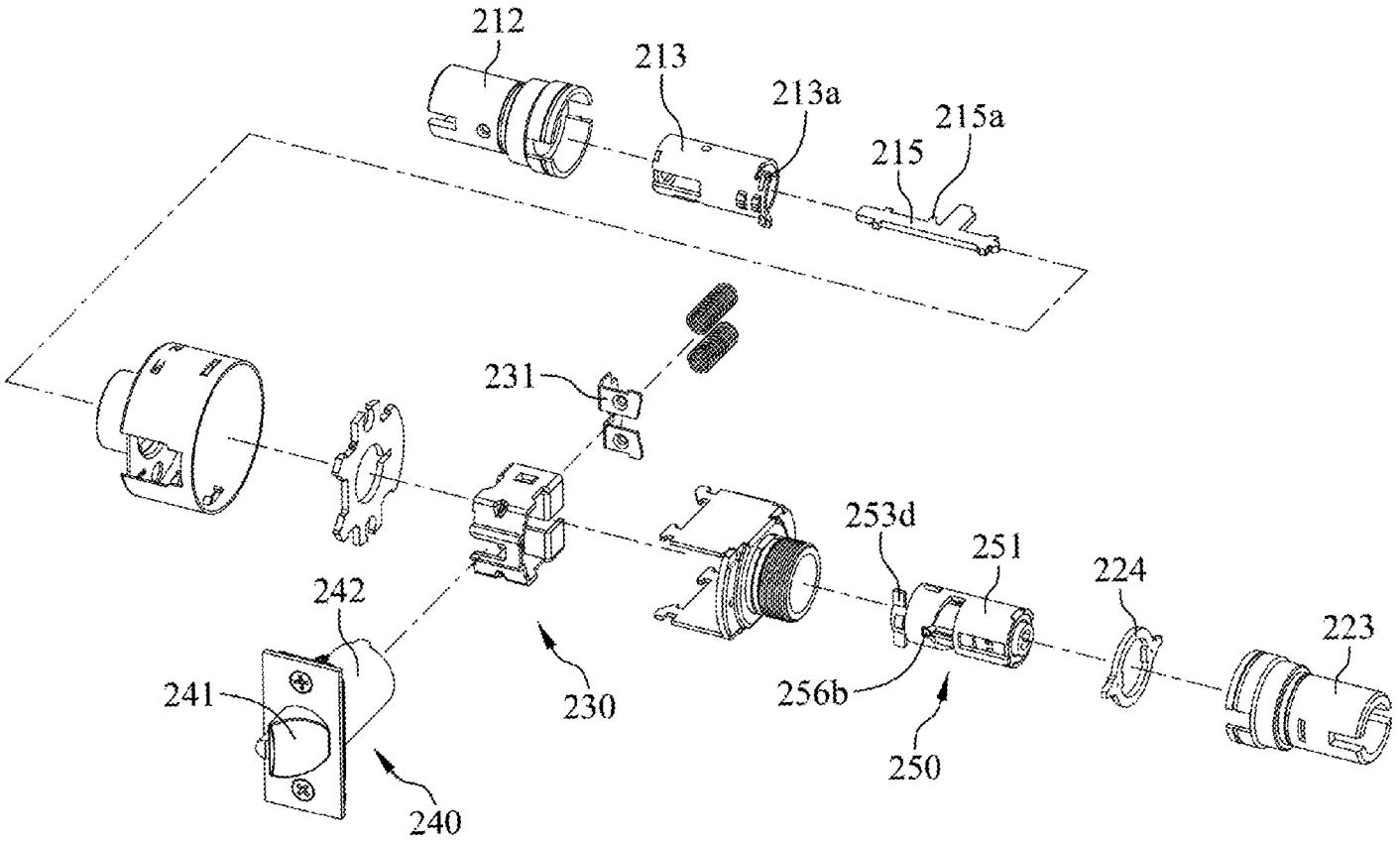
FIG. 10 is a partial perspective exploded diagram illustrating the lock in accordance with the present invention.
Figure 11:
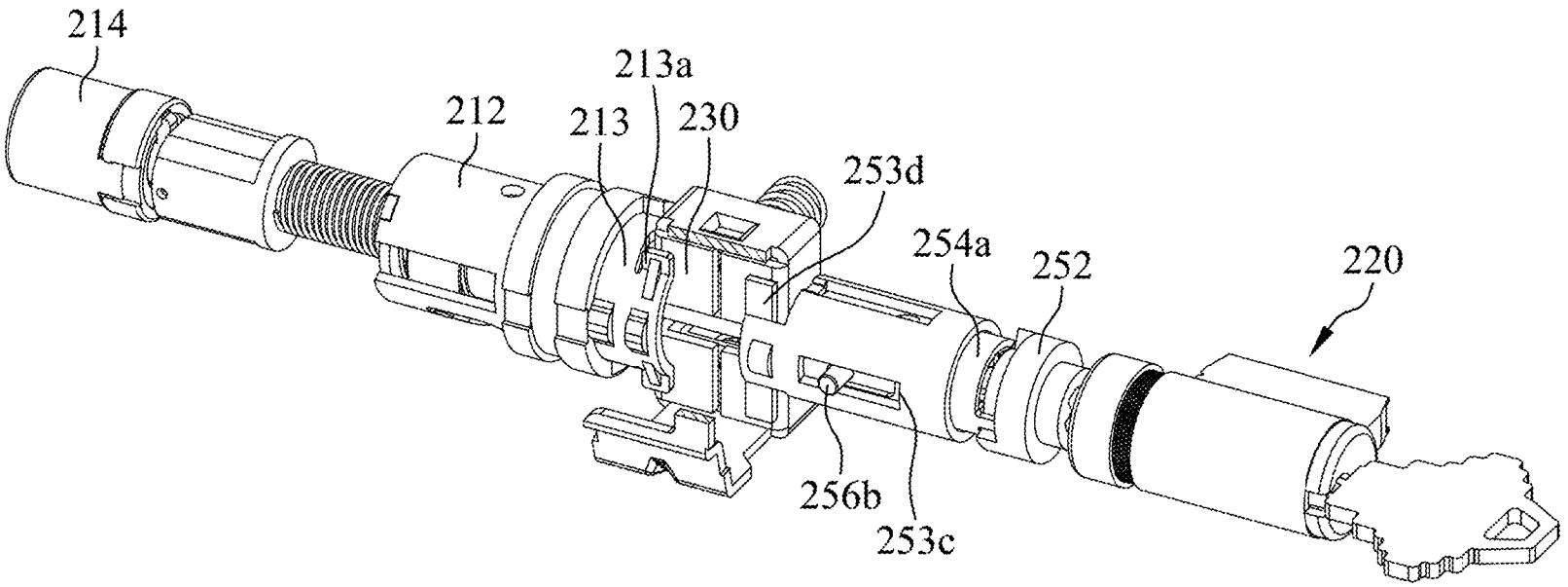
FIG. 11 is a partial perspective assembly diagram illustrating the lock in accordance with the present invention.

With reference to FIGS. 2, 3, 10 and 11, an exterior handle 221 of the exterior handle assembly 220 is able to be turned when the lock 200 is not locked. Referring to FIG. 2, the exterior handle 221 drives an outer axial tube 223 rotate by a first connecting member 222. Referring to FIG. 10, the outer axial tube 223 drives the first driving tube 251 to rotate by a second connecting member 224 at the same time. Referring to FIGS. 3, 5A, 5B and 5C, owing to the bearing portion 256*b* of the driving rod 256 is located within the first lateral constraining hole 251*d* of the first driving tube 251, the second lateral constraining hole 253*c* of the second driving tube 253 and the first area 254*g* of the triangle-shaped through hole 254*c* of the sleeve 254, so the first driving tube 251 is able to press the bearing portion 256*b* of the driving rod 256 to drive the second driving tube 253, the sleeve 254 and the sliding member 255 to rotate simultaneously when the first driving tube 251 is driven to rotate by the outer axial tube 223. With reference to FIGS. 10 and 11, the pushing portion 253*d* of the second driving tube 253 is able to press the retractor 230 to drive the latch 241 of the latch assembly 240 retract into the cylinder body 242 to open the door 10 when the second driving tube 253 is driven to rotate.

Figure 12:
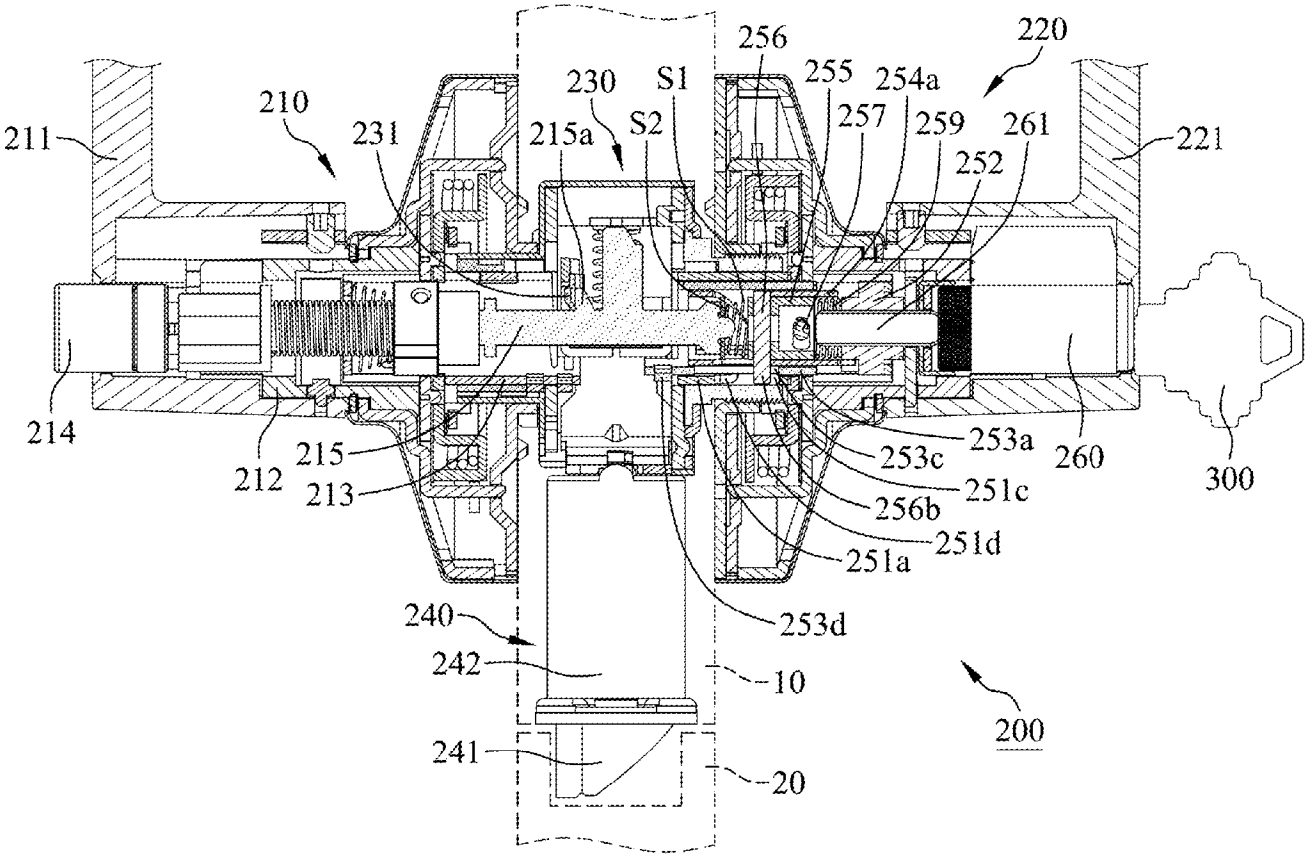
FIG. 12 is a section view diagram illustrating the lock in accordance with the present invention.

With reference to FIGS. 2, 10 and 12, a control button 214 of the interior handle assembly 210 drives a transmission rod 215 of the interior handle assembly 210 to move toward the exterior handle assembly 220 to make a constraining protrusion 215*a* of the transmission rod 215 passing a constraining member 231 of the retractor 230 when the control button 214 of the interior handle assembly 210 is pressed. And the constraining protrusion 215*a* is constrained by the retractor 230 to lock the lock 200.

Figure 13A:
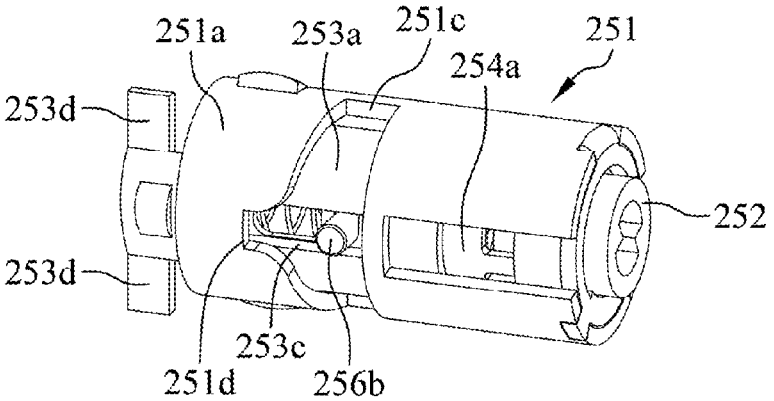
FIG. 13A is a perspective diagram illustrating the clutch driving module of the lock in accordance with the present invention.
Figure 13B:
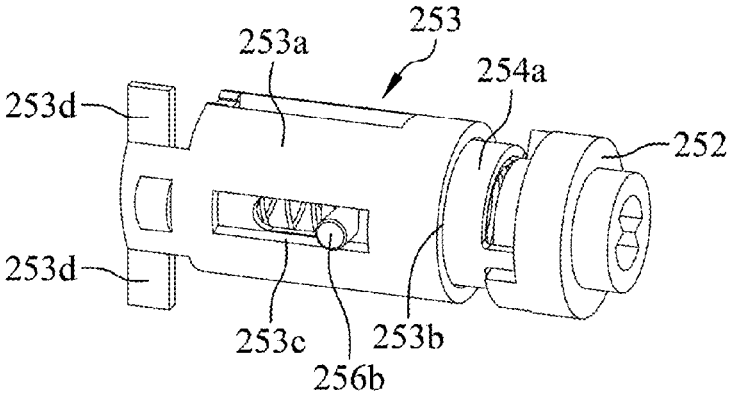
FIG. 13B is a partial perspective diagram illustrating the clutch driving module of the lock in accordance with the present invention.
Figure 13C:
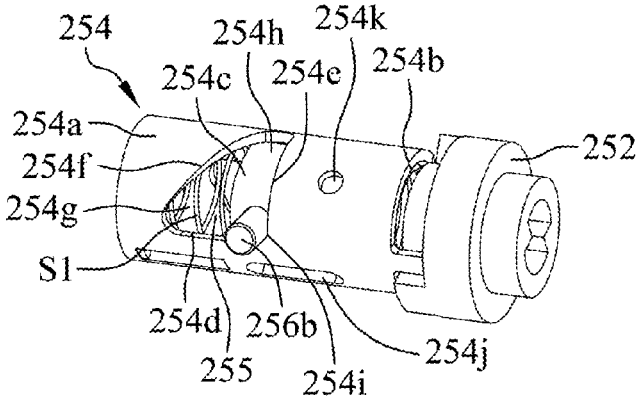
FIG. 13C is a partial perspective diagram illustrating the clutch driving module of the lock in accordance with the present invention.

With reference to FIGS. 12, 13A, 13B and 13C, FIG. 13B is a perspective assembly diagram illustrating the first driving tube 251 being hidden from FIG. 13A, and FIG. 13C is a perspective assembly diagram illustrating the first driving tube 251 and second driving tube 253 both being hidden from FIG. 13A. The transmission rod 215 presses the blocking plate S2 to compress the elastic member S1 when the constraining protrusion 215*a* of the transmission rod 215 is constrained by the retractor 230, the elastic member S1 makes the sliding member 255 moving toward the driving member 252 in the third accommodating space 254*b* of the sleeve 254 to compress the elastic member 259, and wherein the driving rod 256 moves laterally with the sliding member 255. Referring to FIG. 13A, the bearing portion 256*b* of the driving rod 256 moves laterally from the first lateral constraining hole 251*d* of the first driving tube 251 to the longitudinal slot 251*c* of the first driving tube 251. Referring to FIG. 13C, the bearing portion 256*b* of the driving rod 256 moves from the first area 254*g* to the third area 254*i*. Referring to FIGS. 7, 13A, 13B and 13C, the bearing portion 256*b* of the driving rod 256 is located within the longitudinal slot 251*c* of the first driving tube 251, the second lateral constraining hole 253*c* of the second driving tube 253 and the third area 254*i* of the triangle-shaped through hole 254*c*, and the positioning protrusion 257*a* accommodating in the positioning slot 254*j* moves from one end of the positioning slot 254*j* to the other end of the positioning slot 254*j*.

With reference to FIGS. 2, 12 and 13A, the lock 200 is locked. Because the bearing portion 256*b* of the driving rod 256 is located within the longitudinal slot 251*c* of the first driving tube 251, so the outer axial tube 223 merely drives the first driving tube 251 rotate when the exterior handle 221 and the outer axial tube 223 are turned. The first driving tube 251 can not press the driving rod 256 to drive the second driving tube 253 rotate simultaneously. Therefore, the lock 200 is still locked.

With reference to FIGS. 2, 12 and 13A, a key 300 is used to drive a lock cylinder assembly 260 disposed in the exterior handle 221 to unlock the lock 200, wherein the key 300 is turned toward a second direction. In this embodiment, the second direction is clockwise. The key 300 drives a linking plate 261 of the lock cylinder assembly 260 rotate, and the linking plate 261 drives the driving member 252 to rotate toward the second direction. With reference to FIGS. 7 and 13C, the driving member 252 drives the sleeve 254 to rotate toward the second direction to make the lateral wall 254*d* of the sleeve 254 pressing the bearing portion 256*b* of the driving rod 256 to rotate toward the second direction. With reference to FIGS. 12 and 13B, the second ring wall 253*a* of the second driving tube 253 is pushed by the bearing portion 256*b* to make the second driving tube 253 rotating toward the second direction, wherein the pushing portion 253*d* of the second driving tube 253 presses the retractor 230 to drive the latch 241 of the latch assembly 240 retract into the cylinder body 242, and then the door 10 is able to be opened.

Figure 14:
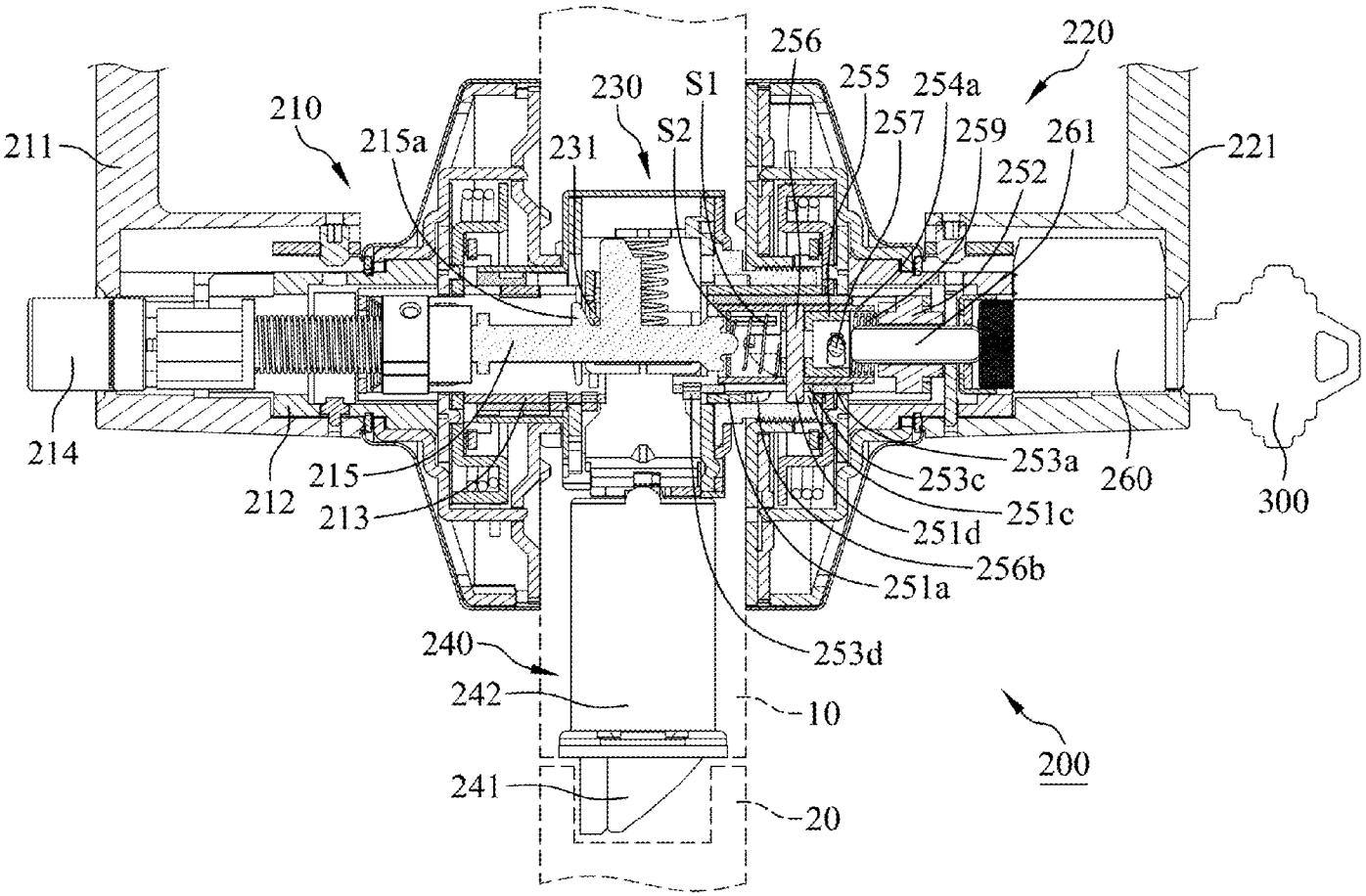
FIG. 14 is a section view diagram illustrating the lock in accordance with the present invention.
Figure 15A:
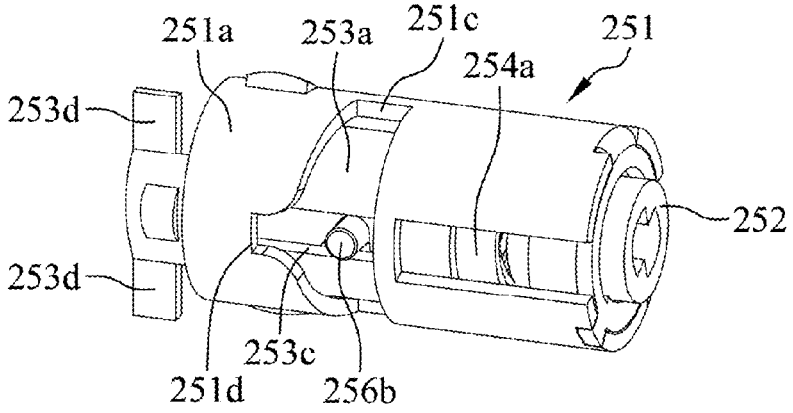
FIG. 15A is a perspective diagram illustrating the clutch driving module of the lock in accordance with the present invention.
Figure 15B:
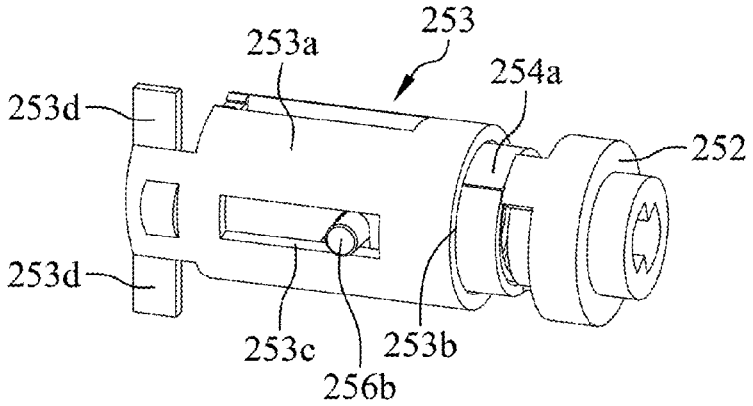
FIG. 15B is a partial perspective diagram illustrating the clutch driving module of the lock in accordance with the present invention.
Figure 15C:
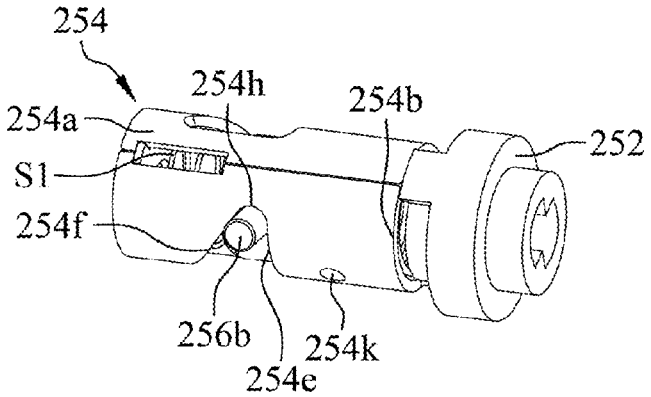
FIG. 15C is a partial perspective diagram illustrating the clutch driving module of the lock in accordance with the present invention.
Figure 16:
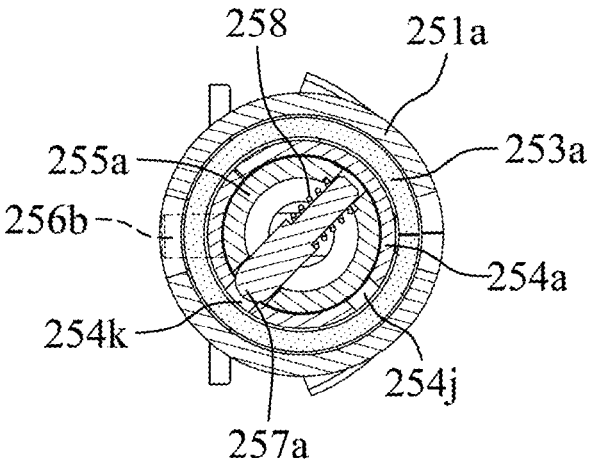
FIG. 16 is a longitudinal section view diagram illustrating the clutch driving module of the lock in accordance with the present invention.

With reference to FIGS. 3, 5A, 5B and 5C, the bearing portion 256*b* of the driving rod 256 is located at the first area 254*g* of the triangle-shaped through hole 254*c* when the control button 214 of the interior handle assembly 210 is not in operation and the lock 200 is unlocked. The clutch driving module 250 is able to make the lock 200 being locked. First, referring to FIGS. 2, 14, 15A, 15B and 15C, the key 300 is turned toward a first direction opposite to the second direction to make the linking plate 261 of the lock cylinder assembly 260 driving the driving member 252 rotate toward the first direction. In this embodiment, the first direction is counterclockwise. With reference to FIGS. 5C, 15C and 16, the driving member 252 drives the sleeve 254 to rotate toward the first direction, and the pushing wall 254*f* of the sleeve 254 pushes the bearing portion 256*b* of the driving rod 256 to make the sliding member 255 and the driving rod 256 moving toward the driving member 252, make the first area 254*g* of the triangle-shaped through hole 254*c* departing from the bearing portion 256*b*, make the positioning slot 254*j* departing from the positioning protrusion 257*a* of the positioning member 257, and make the positioning protrusion 257*a* of the positioning member 257 accommodating in the positioning hole 254*k*. With reference to FIGS. 15A, 15B and 15C, the bearing portion 256*b* is located in the longitudinal slot 251*c* of the first driving tube 251 and the second area 254*h* of the triangle-shaped through hole 254*c* because that the sleeve 254 rotates toward the first direction. Next, the key 300 is pulled out to make the lock 200 being locked. Referring to FIGS. 14 and 15A, owing to the bearing portion 256*b* of the driving rod 256 is located in the longitudinal slot 251*c* of the first driving tube 251, so the first driving tube 251 is not able to drive the second driving tube 253 to rotate simultaneously when the exterior handle 221 is turned to drive the first driving tube 251. Therefore the lock 200 is locked.

With reference to FIG. 12, the control button 214 of the interior handle assembly 210 is pressed to lock the lock 200, and the exterior handle assembly 220 is able to control the lock 200 in lock or unlock independently by the clutch driving module 250. First, referring to FIG. 12, the lock 200 is locked because of the operation of the control button 214. As disclosed in FIGS. 12, 13A, 13B and 13C, the driving rod 256 moves laterally with the sliding member 255, and the bearing portion 256*b* of the driving rod 256 moves laterally from the first lateral constraining hole 251*d* of the first driving tube 251 to the longitudinal slot 251*c* of the first driving tube 251, and the bearing portion 256*b* of the driving rod 256 moves from the first area 254*g* to the third area 254*i*. Thereafter, referring to FIGS. 12, 15A, 15B, 15C and 16, the key 300 is turned toward the first direction to make the linking plate 261 driving the driving member 252 to rotate toward the first direction, the driving member 252 drives the sleeve 254 to rotate toward the first direction to make the first area 254*g* of the triangle-shaped through hole 254*c* departing from the bearing portion 256*b*, and make the positioning slot 254*j* departing from the positioning protrusion 257*a* of the positioning member 257. With reference to FIG. 16, the positioning hole 254*k* is moved to the positioning protrusion 257*a* to make the positioning protrusion 257*a* of the positioning member 257 accommodating in the positioning hole 254*k*. Referring to FIGS. 15A, 15B and 15C, the bearing portion 256*b* is located in the longitudinal slot 251*c* of the first driving tube 251 and the second area 254*h* of the triangle-shaped through hole 254*c*. With reference to FIG. 12, the inner axial tube 212 drives the inner driving axial tube 213 to rotate when the interior handle 211 is turned. The lateral wing plate 213*a* of the inner driving axial tube 213 presses the retractor 230 to make the constraining protrusion 215*a* of the transmission rod 215 departing from the constraining member 231 of the retractor 230, and the retractor 230 drives the latch 241 of the latch assembly 240 to retract into the cylinder body 242 to open the door 10.

Referring to FIGS. 14, 15A, 15B, 15C and 16, although the constraining protrusion 215*a* of the transmission rod 215 has departed from the constraining member 231 of the retractor 230 when the door 10 is closed once again, however, owing to the constraining protrusion 257*a* of the positioning member 257 is constrained in the positioning hole 254*k*, so the elastic member 259 is not able to push the sliding member 255 restore to original position, and the bearing portion 256*b* is still located in the longitudinal slot 251*c* of the first driving tube 251 and the second area 254*h* of the triangle-shaped through hole 254*c*. Even though the exterior handle 221 is turned to make the outer axial tube 223 driving the first driving tube 251 rotate, the first driving tube 251 is still not able to drive the second driving tube 253 to press the retractor 230, so the lock 200 is locked.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A clutch driving module of a lock includes:

a first driving tube having a first ring wall, a first accommodating space, a longitudinal slot and a first lateral constraining hole communicating with the longitudinal slot, wherein the longitudinal slot and the first lateral constraining hole pass through the first ring wall and communicate with the first accommodating space;

a driving member rotatably disposed in the first accommodating space of the first driving tube;

a second driving tube rotatably disposed in the first accommodating space of the first driving tube and having a second ring wall, a second accommodating space and a second lateral constraining hole, wherein the second lateral constraining hole passes through the second ring wall and communicates with the second accommodating space;

a sleeve rotatably disposed in the second accommodating space of the second driving tube and having a third ring wall, a third accommodating space and a triangle-shaped through hole disposed in the third ring wall, wherein the triangle-shaped through hole communicates with the third accommodating space, and the second lateral constraining hole of the second driving tube reveals the triangle-shaped through hole;

a sliding member disposed in the third accommodating space of the sleeve and being able to move laterally in the third accommodating space, wherein the triangle-shaped through hole reveals the sliding member; and a driving rod having a coupling portion and a bearing portion, wherein the coupling portion is coupled with the sliding member, and the bearing portion penetrates through the triangle-shaped through hole of the sleeve, the second lateral constraining hole of the second driving tube and the first lateral constraining hole of the first driving tube.

2. The clutch driving module of a lock in accordance with claim 1, wherein the triangle-shaped through hole of the sleeve comprises a lateral wall, a longitudinal wall and a pushing wall, wherein one end of the pushing wall connects with the lateral wall and the other end of the pushing wall connects with the longitudinal wall, a first included angle is defined between the lateral wall and the pushing wall, there is a first area in terminal of the first included angle, a second included angle is defined between the pushing wall and the longitudinal wall, there is a second area in terminal of the second included angle, and a third included angle is defined between the longitudinal wall and the lateral wall, there is a third area in terminal of the third included angle.

3. The clutch driving module of a lock in accordance with claim 2, wherein the bearing portion is located at the first area, the driving member drives the sleeve to rotate toward a first direction when the driving member rotates along the first direction, the pushing wall of the sleeve pushes the bearing portion of the driving rod to make the sliding member and the driving rod moving toward the driving member, the bearing portion moves laterally from the first lateral constraining hole of the first driving tube to the longitudinal slot of the first driving tube, the first area departs from the bearing portion, and the bearing portion is located at the second area.

4. The clutch driving module of a lock in accordance with claim 2, wherein the bearing portion is located at the first area, the bearing portion of the driving rod moves laterally from the first lateral constraining hole of the first driving tube to the longitudinal slot of the first driving tube and moves from the first area to the third area when the sliding member moves toward the driving member.

5. The clutch driving module of a lock in accordance with claim 4, wherein the driving member drives the sleeve to rotate along a first direction to make the third area departing from the hearing portion when the driving member rotates along the first direction, and the bearing portion is located at the second area.

6. The clutch driving module of a lock in accordance with claim 1 further includes a positioning member disposed at the sliding member, wherein the positioning member comprises a positioning protrusion protruded to the sliding member.

7. The clutch driving module of a lock in accordance with claim 6 further includes at least one elastic member, wherein one end of the elastic member contacts against the positioning member and the other end of the elastic member contacts against the sliding member.

8. The clutch driving module of a lock in accordance with claim 7, wherein the sliding member comprises a fourth ring wall, a fourth accommodating space and a through hole passes through the fourth ring wall and communicates with the fourth accommodating space, the positioning member and the elastic member are disposed in the fourth accommodating space, one end of the elastic member contacts against the fourth ring wall and the other end of the elastic member contacts against the positioning protrusion, and the positioning protrusion protrudes to the fourth ring wall via the through hole.

9. The clutch driving module of a lock in accordance with claim 6, wherein the sleeve comprises a positioning hole disposed in the third ring wall for accommodating the positioning protrusion.

10. The clutch driving module of a lock in accordance with claim 9, wherein the sleeve comprises a positioning slot disposed in the third ring wall, and the positioning protrusion is accommodated in the positioning slot.

11. The clutch driving module of a lock in accordance with claim 1 further includes at least one elastic member, wherein the elastic member is disposed in the third accommodating space of the sleeve and located between the driving member and the sliding member.

12. The clutch driving module of a lock in accordance with claim 1 further includes a plurality of elastic members and a blocking plate, wherein the elastic members and the blocking plate are disposed in the third accommodating space of the sleeve, the sliding member is disposed between the elastic members, and wherein one of the elastic members is located between the driving member and the sliding member, and another one of the elastic members is located between the blocking plate and the sliding member.

* * * * *